United States Patent [19]

Jeanson

[11] 4,400,896

[45] Aug. 30, 1983

[54] SWINGING DEVICE FOR DREDGER

[75] Inventor: Rene H. Jeanson, Auzay, France

[73] Assignee: VALEO, Paris, France

[21] Appl. No.: 358,804

[22] Filed: Mar. 16, 1982

[30] Foreign Application Priority Data

Mar. 25, 1981 [FR] France ..... 81 05956

[51] Int. Cl.[3] ..... E02F 3/90

[52] U.S. Cl. ..... 37/67; 180/139

[58] Field of Search ..... 37/67; 212/245; 414/687, 695.5; 92/118, 119; 180/139

[56] References Cited

U.S. PATENT DOCUMENTS

| | | | |
|---|---|---|---|
| 3,047,171 | 7/1962 | Long . | |
| 3,275,163 | 9/1966 | Schaeff . | |
| 3,338,329 | 8/1967 | Orth | 180/139 |
| 4,204,347 | 5/1980 | Wolters | 37/67 |
| 4,242,816 | 1/1981 | Jeanson | 37/67 |

FOREIGN PATENT DOCUMENTS 1053409 4/1967 United Kingdom .

*Primary Examiner*—Clifford D. Crowder

*Attorney, Agent, or Firm*—Young & Thompson

[57] ABSTRACT

A swinging device for a dredger of the kind having a two-part articulated dredging boom comprises at least one jack having a jack body provided with a piston rod, the jack body and the piston rod being connected respectively by two connecting joints to separate parts, one of which is fixed, while the other pivots and is coupled to the movable dredging arm. The connecting joint of said jack body is located on a yoke which prolongs this body on the same side as the side on which the piston rod extends, the connecting joint of said jack body thus being located in the vicinity of the connecting joint of said piston rod.

10 Claims, 7 Drawing Figures

SWINGING DEVICE FOR DREDGER

BACKGROUND OF THE INVENTION

The present invention relates to an oscillating or swinging device for a dredger of the kind comprising a dredging boom having two relatively movable arms.

A dredger of this kind is known from U.S. Pat. No. 4,242,816. The first arm is generally provided with a platform at one end which it moves over the water bottom in successive steps of approximately one meter. Between steps, this platform remains fixed on the water bottom. The second arm, which possesses a working tool at its end, is articulated to this platform about a substantially vertical axis. This arm is oscillated by a swinging device to execute a sweeping movement with an amplitude of approximately 140° (±70° relative to a middle position).

The swinging device is one of the elements of this type of dredger which is difficult to produce in a simple, robust and economical way.

Disadvantages of the known swinging devices which may be mentioned are those of:

(i) a lack of torque in the extreme position of the second dredging arm when the latter is 70° to port or 70° to starboard;

(ii) a considerable bulk and a complex structure; and (iii) a cost price which is consequently high.

In one embodiment of the prior art, swinging is effected by means of one or more jacks, each having a body which is fixed to the platform by means of a swivel pin. The piston rod of the jack is articulated to the pivoting part of the swinging device, this part being fixed to the second arm.

In the extreme positions, that is to say in the position wherein the angle between the jack and the swinging dredging arm approaches 180°, there is a deficiency of torque. Since the body of the jack is fixed to the platform, the size of the platform is governed by this factor. The overall structure of the dredger is consequently made heavier, and the cost price is increased.

SUMMARY

To overcome these various disadvantages, the present invention proposes a swinging device for a dredger, comprising at least one jack having a body and a piston provided with a rod, the body and the rod being connected respectively by two connecting joints to two separate parts, one of which is fixed, whilst the other pivots and is connected to an articulated dredging arm; the device is characterised in that the connecting joint of said jack body is located on a yoke which prolongs this body on the same side as the side on which the piston rod extends, the connecting joint of said body thus being located in the vicinity of the connecting joint of said rod.

As a result of these arrangements, the torque applied to the arm during the sweeping movement undergoes very few variations during the swinging action. At all events, it is advantageously greater in the extreme positions than is the case with the products already known. The bulk of the structure is reduced because of the location of the coupling of the jack body to the fixed part. A saving in terms of construction follows from this.

According to another characteristic of the invention, the rod of the swinging jack is provided, at its joint with a cam possessing a stud, the fixed part having at least one slide forming a guide means which is associated with the swinging jack and in which the stud engages when the swinging dredging arm is in the vicinity of a middle position.

In fact, when the joint axis of the rod is aligned with the joint axis of the jack body, there is a risk that the position of the jack will waver or wobble depending on the embodiment chosen. This is remedied by the arrangement mentioned above.

DESCRIPTION OF THE PREFERRED EMBODIMENTS

Figure 1:
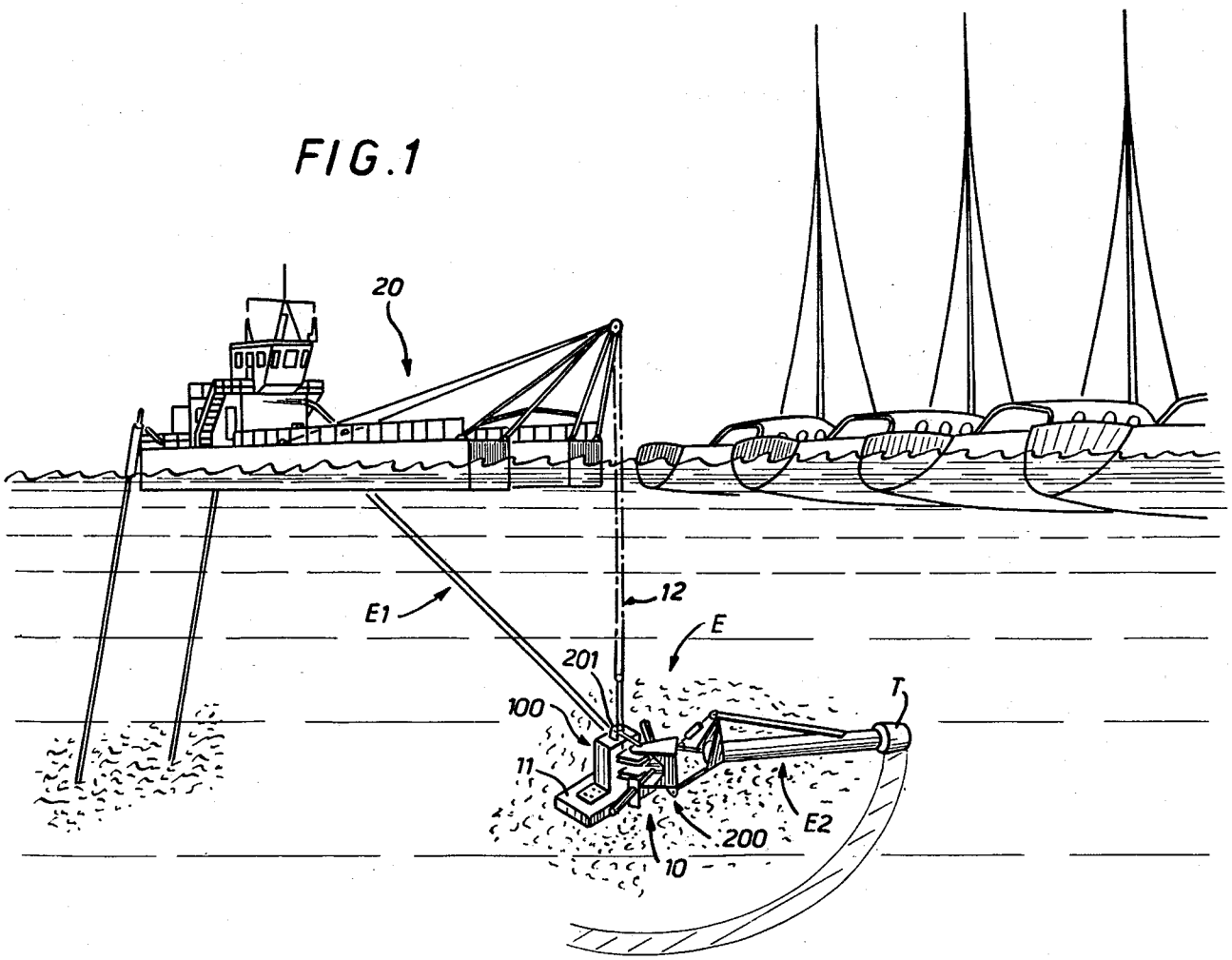
FIG. 1 is a general diagrammatic view of a dredger comprising a two-part articulated dredging boom.

FIG. 1 is a general diagrammatic view of the apparatus. It shows a dredger comprising a surface platform 20 and a dredging boom E having two arms E1 and E2 connected by a device shown at 10. This device 10 rests, under working conditions, on the bottom by means of a platform 11 and interacts with a lifting means 12 enabling the dredging arms E1 and E2 to be raised. The arm E2 possesses, at its free end, a working tool T.

The device 10 possesses the apparatus necessary to enable the arm E2 to swing. It is this device which is of particular interest and which will be described with reference to FIGS. 2 to 7.

Figure 2:
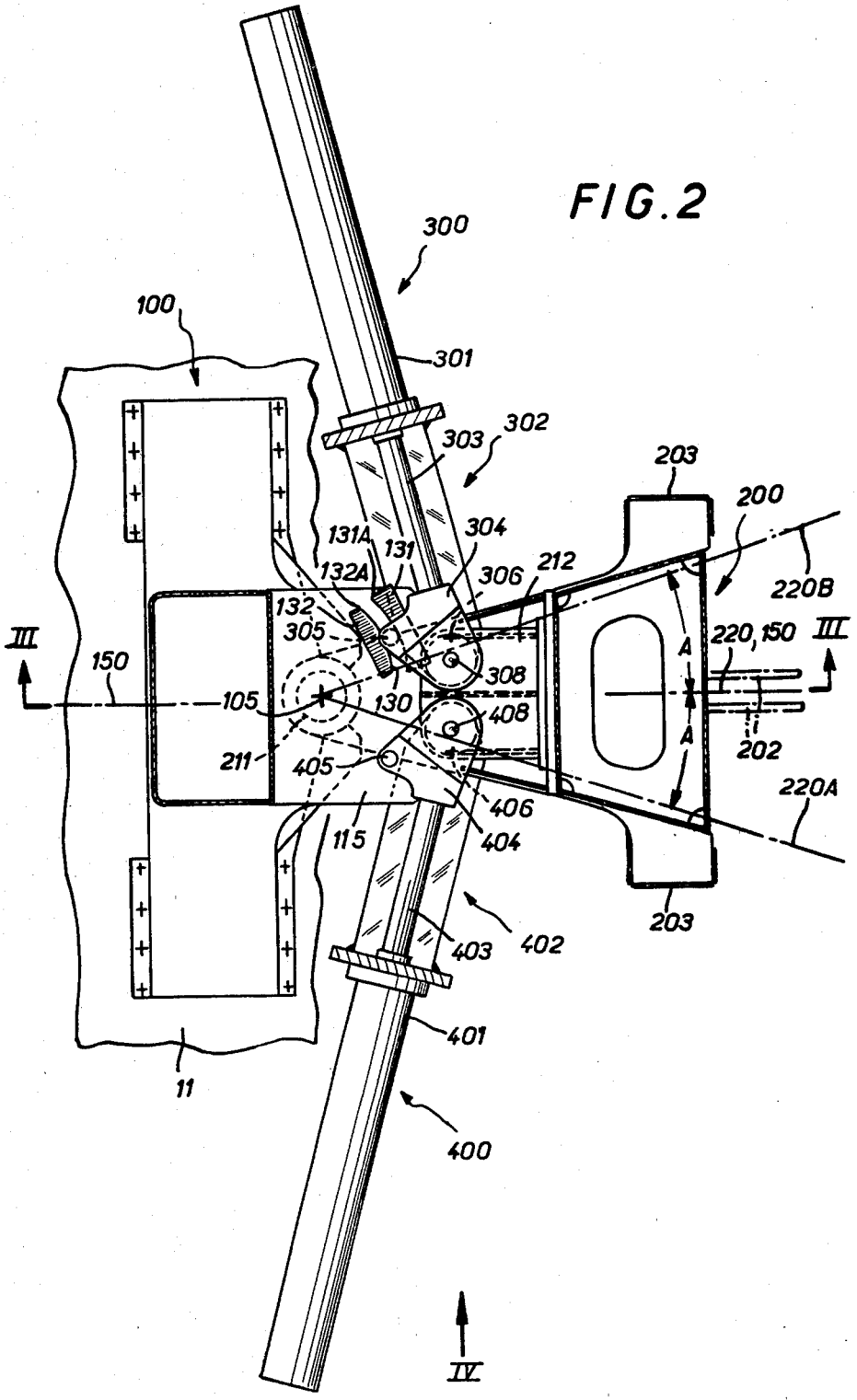
FIG. 2 is a plan view, partially in section along the line II—II of FIG. 3, of the device according to the invention, the articulated assembly being shown in a middle position.
Figure 3:
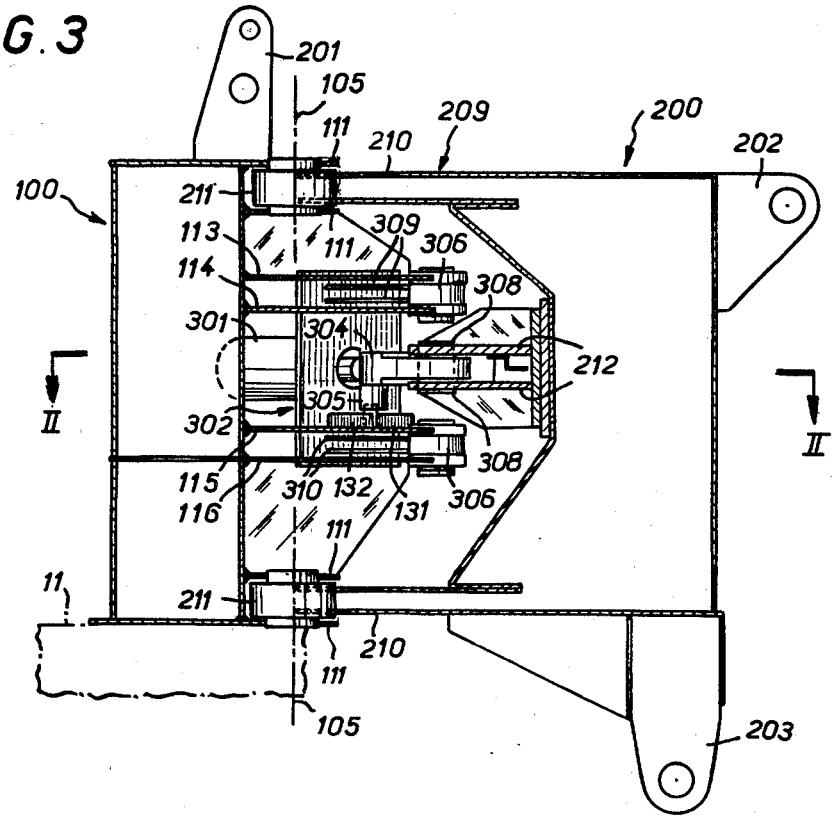
FIG. 3 is a sectional view of the device according to the invention, along the line III—III of FIG. 2.
Figure 4:
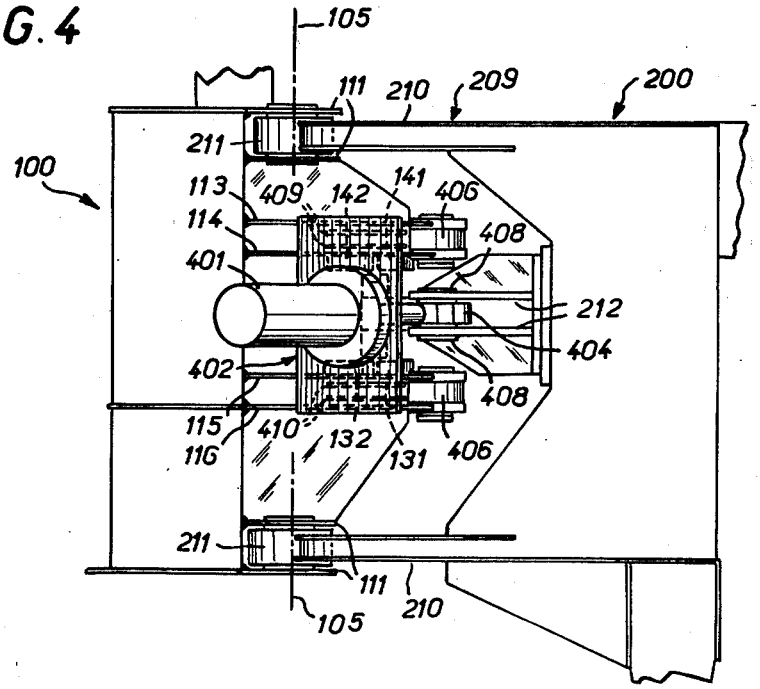
FIG. 4 is a side view according to the arrow IV of FIG. 2 of the device according to the invention.

According to the embodiment chosen and illustrated, the swinging device comprises a fixed part or frame 100 fixed to the platform 11 and connected to the lifting system by the fastening 201, and a pivoting assembly 200 fixed to the arm E2 by means of the fastenings 202 and 203 (FIGS. 1, 2 and 3). The assembly 200 is mounted pivotally about an axis 105 on the fixed part 100. The main pivot which embodies the axis 105 is described below.

Figure 5:
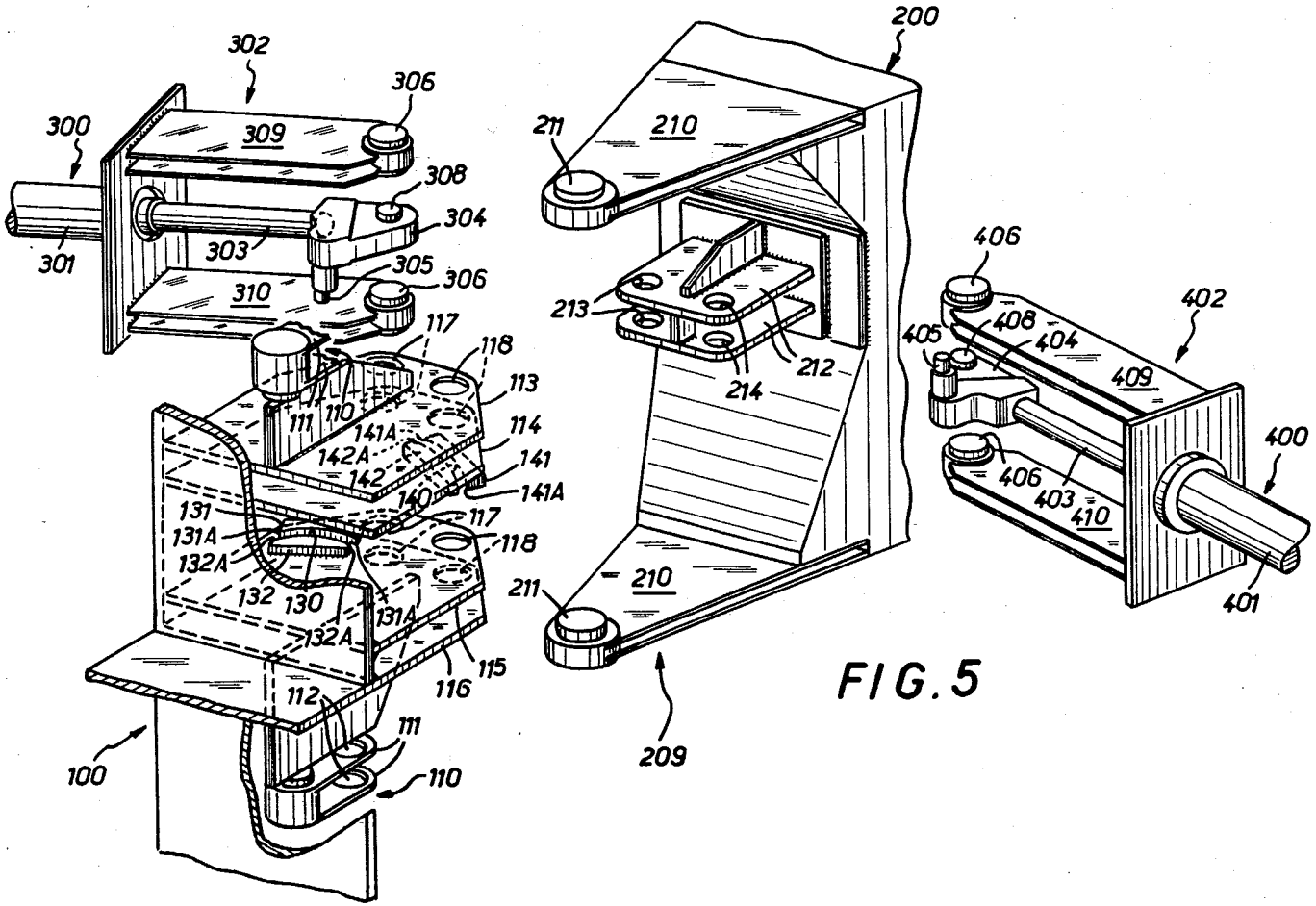
FIG. 5 is an exploded perspective view of the device according to the invention.

The assembly 200 comprises a main yoke 209 formed by plates 210. These plates each support at their ends shaft end 211 (FIG. 5). The pivoting assembly 200 is retained in the fixed part 100 by the main yoke 209, the plates 210 of which are each engaged in a fork 110 fixed to the fixed part 100 and formed by the plates 111. These plates 111 each have a bore 112. The shaft ends 211 are accommodated in the bores 112. The assembly formed by the forks 110 and the shaft ends 211 and supported by the plates 210 of the yoke 209 forms the main pivot thus embodying the axis of rotation 105.

The pivoting assembly 200 also possesses two plates 212, each having two bores 213 and 214. The fixed part 100 possesses four plates, 113, 114, 115 and 116 which each have two bores 117 and 118.

Two jacks 300 and 400 control the rotation of the pivoting assembly 200. The jacks are mounted in direct drive, on the one hand:

on the pivoting assembly 200 by means of plates 212 having bores 213 and 214, and, on the other hand;

on the fixed part 100 by means of the plates 113, 114, 115 and 116 which all have the bores 117 and 118.

The jack 300 (400) possesses a body 301 (401) fixed to a yoke 302 (402) formed by two plates 309 (409) and 310 (410). It also possesses a rod 303 (403) fixed to a piston (not shown) and ending in a cam 304 (404).

Figure 7:
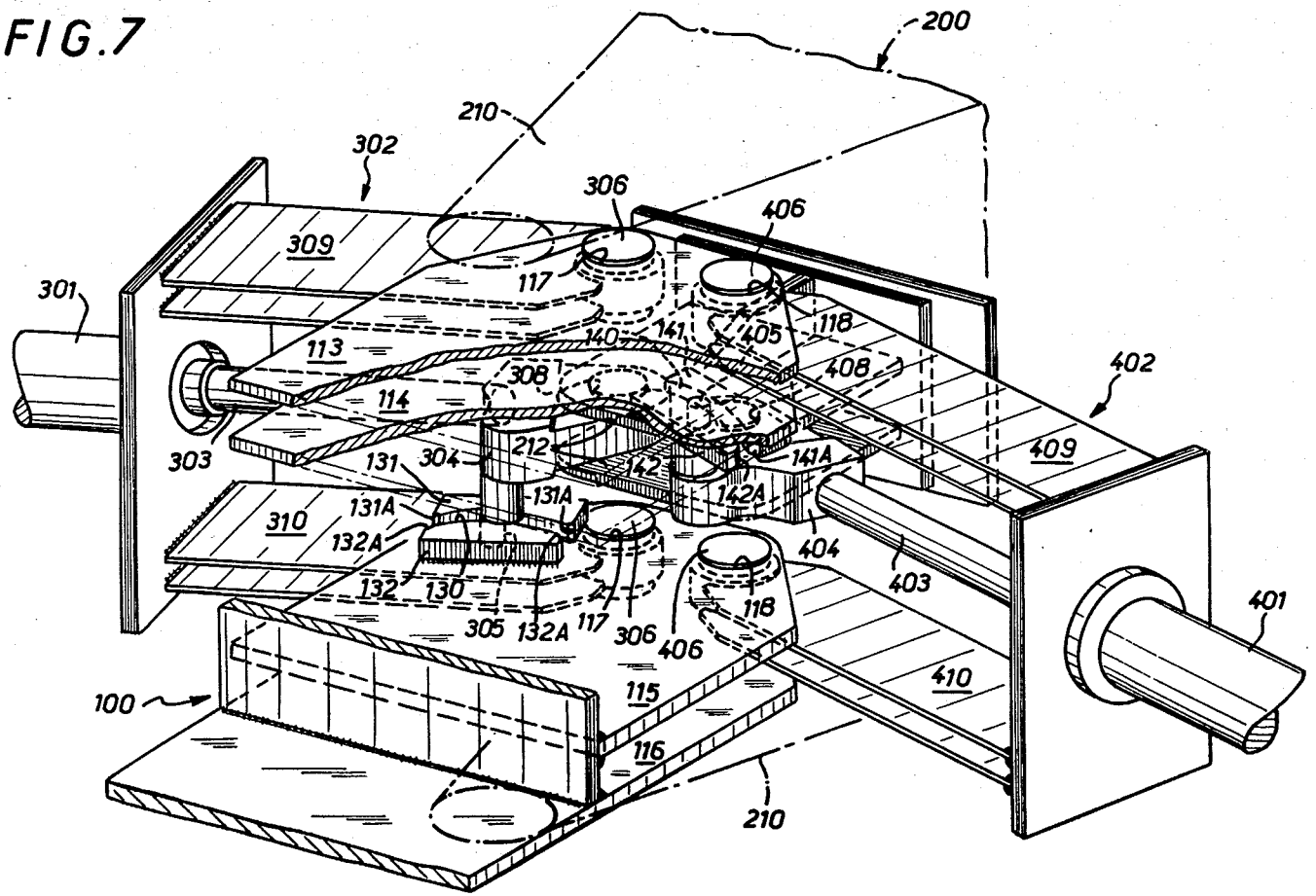
FIG. 7 is a perspective view, with partial cut-away portions, of the device according to the invention.

The assembling of the fixed part 100, the pivoting assembly 200, the jack 300 and the jack 400 will now be described. Reference will be made to FIGS. 5 and 7 to enable this description to be followed.

It has already been said that the pivoting assembly 200 was mounted on the fixed part 100 by means of the main yoke 209 of the forks 110 and of the shaft ends 211, thus forming the main pivot. For the sake of greater clarity, this main pivot has not been shown in FIG. 7 and is indicated there by dot-and-dash lines only.

The plates 409 and 410 of the yoke 402 of the jack 400 are accommodated in yokes formed respectively by the plates 113 and 114 for the plate 409 and by the plates 115 and 116 for the plate 410. Shaft ends 406 located at the ends of the plates 409 and 410 are accommodated in the bores 118 of the plates 113, 114, 115 and 116 to form the joint of the body 401 of the jack 400 which is thus mounted pivotally on the fixed part 100.

The jack 300 is mounted pivotally on the fixed part 100 in the same way by means of the shaft ends 306 located at the ends of the plates 309 and 310, the shaft ends 306 being accommodated in the bores 117 of the plates 113, 114, 115 and 116, thus forming the joint of the body 301 of the jack 300.

The cam 404 of the rod 403 is accommodated in a yoke formed by the plates 212 of the pivoting assembly 200. A shaft end 408 fixed to the cam 404 is engaged in the bores 214 of the plates 212 to form the joint of the rod 403 of the jack 400 which is thus mounted pivotally on the pivoting assembly 200.

The rod 303 of the jack 300 is mounted pivotally on the pivoting assembly 200 in the same way by means of the bores 213 of the plates 212 and a shaft end 308 which is accommodated therein to form thus the joint of the rod 303.

Figure 6:
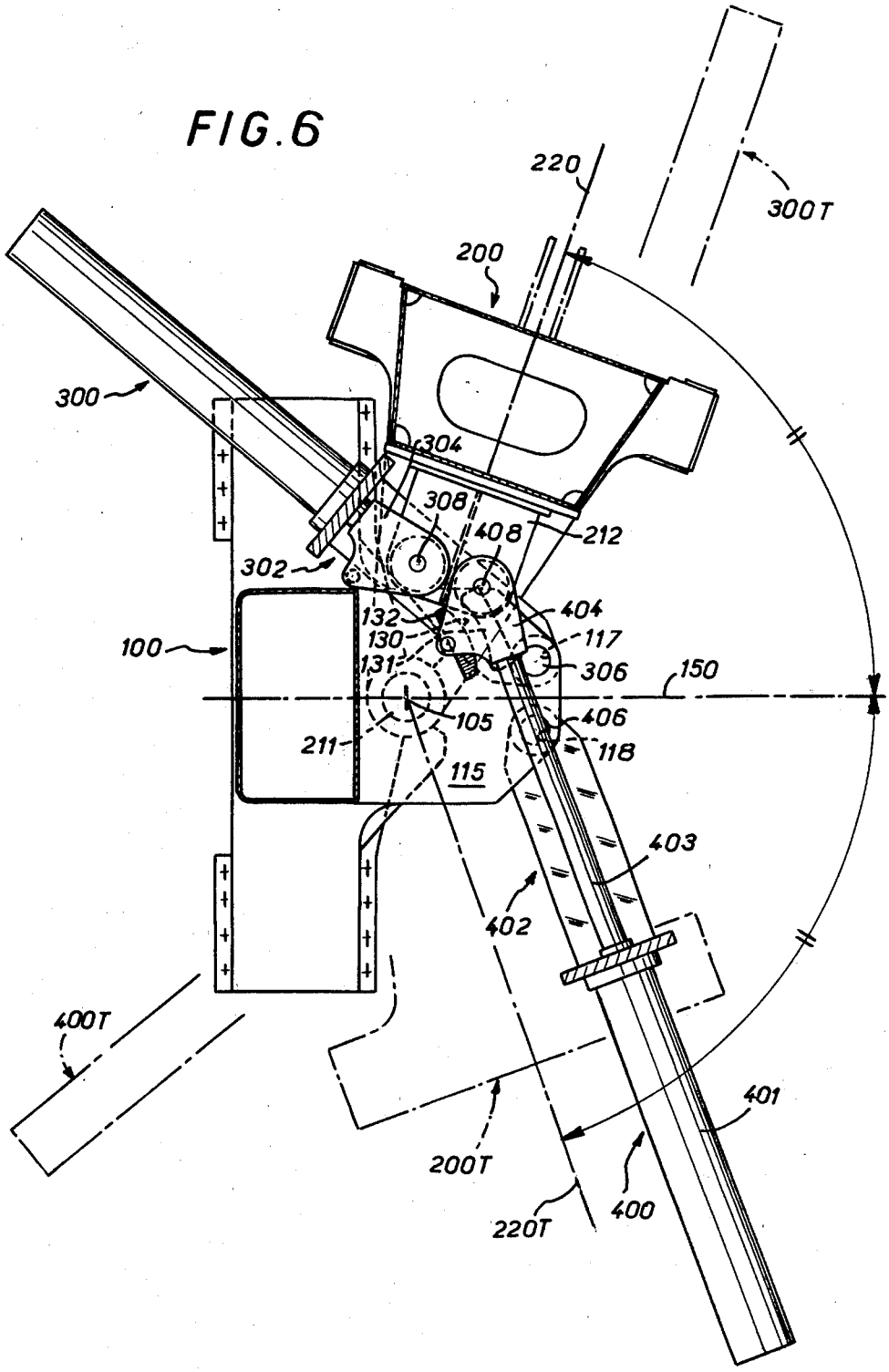
FIG. 6 is a plan view, partially in section, of the device according to the invention, the pivoting assembly being shown in its extreme port position.

FIG. 6 illustrates how the device functions. The pivoting assembly 200 is shown in its extreme port position. It will be seen that the body of each jack is mounted pivotally on the fixed part 100 and bears on the latter by means of the shaft ends 306 and 406, whilst the rod of each jack is the drive element making it possible, by means of the cams 304 and 404 and the shaft ends 308 and 408 on the latter, to pivot the assembly 200 to port or to starboard about the axis 105.

Although FIG. 6 shows the assembly 200 in its extreme port position, the assembly 200 can be seen in the Figure in its extreme starboard position at 200T, and also the corresponding position of the axis 220 can be seen at 220T and that of the jacks 300 and 400 at 300T and 400T.

Referring again to FIG. 2, it will be seen that when the arm E2 approaches a middle position (the axes 150 and 220 merged) by means of the pivoting assembly 200, the shaft ends 406 and 408, on the one hand, and 306 and 308, on the other hand, are aligned and, consequently, the joint axis of the body 301 of the jack 300 is aligned with the joint axis of the rod 303 in this same jack. The same is true of the joint axis of the body 401 of the jack 400 which, in this middle position, is aligned with the joint axis of the rod 403 of the same jack. It follows that when the dredging ladder is in an upright position, the jacks 300 and 400 rotate freely and can consequently pivot freely about the axes determined in this way, whereas, when the pivoting assembly 200 shifts to port or to starboard (FIG. 6), the axes of rotation of the body and of the rod of each jack are no longer merged, thus determining one position and one only for the jacks 300 and 400 corresponding to the angle formed at each moment by the axis 220 of the assembly 200 with the axis 150 of the fixed part 100.

To prevent the jacks from wobbling, which would be caused by the free rotation of these when the pivoting assembly 200 approaches a middle position, and above all to prevent the loss of torque which would arise from this, a device for guiding the jacks is mounted on the fixed part 100 to guide them in the course of an angular movement of the assembly 200 of approximately 10° to 20° on either side of the middle position. This movement is shown in FIG. 2 by two angles A formed by the axes 220A and 220B with the axis 150, the axes 220A and 220B representing respectively the axis 220 when the assembly 200 pivots through an angle A to starboard or to port.

For this purpose, a slide 130 formed by the pieces 131 and 132 is located on the upper face of the plate 115 and a slide 140 formed by the pieces 141 and 142 is located on the lower face of the plate 114. The pieces 131, 132, 141 and 142 are chamfered at their ends at 131A, 132A, 141A and 142A. The cams 304 and 404 of the rods 303 and 403 of the jacks 300 and 400 each possess a stud 305 and 405, the stud 305 being located on the lower face of the cam 304 and the stud 405 being located on the upper face of the cam 404.

FIGS. 2, 3, 4 and 7 show that when the pivoting assembly 200 approaches the middle position the studs 305 and 405 are engaged respectively in the slides 130 and 140, the chamfers 131A, 132A, 141A and 142A making this engagement easier. FIG. 6 illustrates why the slide 130 must be located on the upper face of the plate 115 and the slide 140 on the lower face of the plate 114: when the pivoting assembly is in one of its extreme positions, in this case to port, the stud 405 must be able to pass over the pieces 131 and 132 without being impeded by the latter, which explains why it is located on the upper face of the cam 404, the slide 140 then being located, as a result, on the lower face of the plate 114.

It will be appreciated that the respective distances between the axis 105 and the bores 117, 118, 213 and 214 can be determined in such a way that the force which the jacks 300 and 400 must provide undergoes little variation as a function of the angle formed by the arm E2 with the arm E1.

The invention is not limited to the embodiments described and illustrated, but includes an alternative form and/or combination of the various elements within the scope of the appended claims.

In particular, it will be understood that the device according to the invention can function with only one jack.

Moreover, the joint axes of the bodies 301 and 401 have been arranged side by side in the embodiment described and illustrated. Clearly, these axes can be merged in another embodiment.

Finally, in the embodiment described and illustrated, the body of each jack bears on the fixed part and the rod ensures the pivoting of the pivoting assembly. These respective functions of the body and of the rod of each jack can be interchanged without departing from the scope of the invention.

What I claim is:

1. A swinging device for a dredger having an articulated dredging arm for movement between limit positions to opposite sides of a middle position, said swinging device comprising two jacks respectively disposed on opposite sides of said articulated dredging arm, each of said jacks having a jack body and a jack piston provided with a piston rod, a yoke extending from each of said jack bodies in the same direction as the associated piston rod, said yokes having means for pivotally mounting said jack bodies on a fixed part about respective axes, means pivotally connecting said piston rods to said dredging arm about respective axes, the pivot axes of said jack bodies on said fixed part being substantially coextensive with the pivot axes of the respective piston rods on said dredging arm in said middle position of said dredging arm, thereby increasing torque applied to said dredging arm in said positions.

2. A swinging device for a dredger having an articulated dredging arm for movement between limit positions to opposite sides of a middle position, said swinging device comprising two jacks respectively disposed on opposite sides of said articulated dredging arm, each of said jacks having a jack body and a jack piston provided with a piston rod, a yoke extending from each of said jack bodies in the same direction as the associated piston rod, said yokes having means for pivotally mounting said jack bodies on a fixed part, means for pivotally connecting said piston rods to said dredging arm, said means for pivotally mounting said jack bodies being adjacent the means for pivotally connecting their respective piston rods to said dredging arm, a guide means associated with each of said jacks, said guide means being located on said fixed part and interacting with cooperable means on the associated jack when said dredging arm is in a guided zone in the vicinity of said middle position, each guide means comprising a slide in said fixed part and each said cooperating means comprising a stud element which engages and is guided in the associated slide.

3. A device according to claim 2, wherein said guide zone has an angular range of about 10° to 20° to each side of said middle position.

4. A device according to claim 3, wherein the length of each said slide is such that the associated stud element remains engaged in the slide over a range of angular movement by said dredging arm of about 10° to 20° to each side of said middle position.

5. A device according to claim 3, wherein the ends of each said slide are chamfered to facilitate engagement of the corresponding stud element when the associated jack enters the guided zone.

6. A device according to claim 3, wherein said slides associated with the respective jacks are arranged in different planes.

7. A swinging device for a dredger having an articulated dredging arm for movement between limit positions to opposite sides of a middle position, said swinging device comprising two jacks respectively disposed on opposite sides of said articulated dredging arms, each of said jacks having a jack body and a jack piston provided with a piston rod, a yoke extending from each of said jack bodies in the same direction as the associated piston rod, said yokes having means for pivotally mounting said jack bodies on a fixed part, means for pivotally connecting said piston rods to said dredging arm, said means for pivotally mounting said jack bodies being adjacent the means for pivotally connecting their respective piston rods to said dredging arm, a guide means associated with each of said jacks, said guide means being located on said fixed part and interacting with cooperable means on the associated jack when said dredging arm is in a guided zone in the vicinity of said middle position for preventing wobbling of said dredging arm.

8. A swinging device according to claim 7, wherein one of said guide means and cooperable means comprises a slide and the other comprises a stud element.

9. A swinging device according to claim 7, wherein said guided zone extends about 10° to 20° to each side of said middle position.

10. A swinging device according to claim 8, wherein said stud elements on the respective jacks extend in opposite vertical direction.

* * * * *